United States Patent [19]

Czirr

[11] Patent Number: 4,686,849

[45] Date of Patent: Aug. 18, 1987

[54] METHOD FOR DETERMINING MINE ROOF COMPETENCY

[76] Inventor: John B. Czirr, 1830 E. Yoon, Mapleton, Utah 84663

[21] Appl. No.: 805,772

[22] Filed: Dec. 6, 1985

[51] Int. Cl.[4] ..... G01N 15/08; G01N 19/08

[52] U.S. Cl. ..... 73/38; 73/40.7

[58] Field of Search ..... 73/40.7, 38, 37, 40

[56] References Cited

U.S. PATENT DOCUMENTS

| | | | |
|---|---|---|---|
| 3,035,440 | 5/1962 | Reed | 73/38 X |
| 3,106,089 | 10/1963 | Scott et al. | 73/40.5 |
| 3,111,655 | 11/1963 | Kotarsky et al. . | |
| 3,343,408 | 9/1967 | Mayer, Jr. | 73/151 |
| 3,743,355 | 7/1973 | Blackwell et al. . | |
| 4,043,395 | 8/1977 | Every et al. . | |
| 4,052,885 | 10/1977 | Shuck | 73/38 |
| 4,145,915 | 3/1979 | Oertle et al. | 73/37 |
| 4,173,141 | 11/1979 | Kissell et al. | 73/40.7 |
| 4,272,128 | 6/1981 | Jacoby . | |
| 4,353,249 | 10/1982 | Lagus et al. | 73/155 |
| 4,420,975 | 12/1983 | Nagel et al. | 73/155 |
| 4,474,409 | 10/1984 | Trevits et al. . | |
| 4,495,805 | 1/1985 | Dowling et al. | 73/155 |
| 4,531,403 | 7/1985 | de Korompay et al. | 73/38 |

FOREIGN PATENT DOCUMENTS

| | | | |
|---|---|---|---|
| 954053 | 11/1956 | Fed. Rep. of Germany | 73/38 |

*Primary Examiner*—Stewart J. Levy
*Assistant Examiner*—Joseph W. Roskos

[57] ABSTRACT

Mine roof competency is determined by injecting a pressurized gas into a borehole drilled in the roof of the mine and measuring the rate of pressure loss. A high rate of pressure loss is indicative of a dangerous mine roof. A tracer gas may also be injected into the borehole to determine the extent of cracks in the roof if a dangerous condition has been determined.

12 Claims, 3 Drawing Figures

19
12
11
2
1
7
6
5
4
3
8
9
10

Correlation plot. (Numbers refer to Site Numbers.)

METHOD FOR DETERMINING MINE ROOF COMPETENCY

BACKGROUND OF THE INVENTION

The method herein disclosed is used to determine mine roof competency, i.e., whether a mine ceiling is likely to collapse, by detecting and surveying cracks in rock strata through testing with packer assemblies in boreholes drilled in the mine ceiling.

Other methods of asserting mine roof competency are known. For example, many mine roof warning devices detect minor shifts in the strata of the mine ceiling which indicate impending collapse. Most of the devices that sense these shifts have had only limited success due to their complexity and/or insensitivity. Further, all of these devices will only provide a warning after the ceiling has already reached an extremely dangerous state. By the time these devices alert the mine personnel to the danger it often is too late to adequately prepare for the collapse. The need has hence been recognized for a system that detects mine roof flaws well before the time when the roof collapses.

More sophisticated techniques such as spectral analysis of acoustical impact signals, ultrasonic reflectivity, and infrared temperature differential analysis have been suggested as means for evaluating mine roof competency, but all are limited to the detection of the first crack above the mine ceiling. A truly effective technique must be able to determine whether there are additional cracks located above the lowest crack.

Inflatable packers have been used in mine boreholes for purposes unrelated to determining mine roof competency. Packers are inflatable bladders that are used to seal off vertical sections of the borehole so that pressurized fluid can be supplied to an isolated portion of the borehole. U.S. Pat. No. 4,072,015 discloses the use of a packer assembly to supply pressurized fluid between inflated packers to prevent the collapse of a borehole. U.S. Pat. No. 4,474,409 discloses a packer assembly in which a fracturing fluid is supplied through a conduit to an isolation zone in a borehole between two packers. The fluid pressure is increased until the surrounding rock is fractured. The purpose of this induced fracturing is to allow methane gas to be released from pockets in coal mines. This patent also mentions that the packer assembly can be used to measure variations in permeability along the length of the borehole by injecting pressurized fluid. The fluid used in that method is supplied from the mine working area and comprises water and other materials, often sand. There is no indication in the reference that the disclosed packer can be used to assess the likelihood of mine roof collapse.

SUMMARY

The present invention is a two-step method involving four separate tasks. First, pressurized gas is injected into an isolated region of a borehole drilled into the mine roof to be tested. Once the pressure in the borehole reaches a predetermined level, the gas supply is cut off and the rate of pressure loss is measured. The pressure loss rates may be determined at various vertical sections within the borehole, and then combined via a mathematical expression to give a weighted mine roof competency factor corresponding to the degree of cracking in the mine roof. If the pressure loss measurements indicate that the mine roof may be sufficiently cracked to be a potential danger, but are not per se conclusive, the borehole is then injected with a pressurized tracer gas such as air mixed with sulfur hexafluoride. This gas may be supplied from the same source as that used to pressurize the borehole in the first step. Finally, while the tracer gas is being furnished to the borehole, the tester surveys the area of the ceiling surrounding the borehole with a tracer gas detector to locate vertical cracks in the mine roof.

DETAILED DESCRIPTION

The inventive method described herein is a two-step process for determining whether a mine roof is likely to collapse. However, the first step of this method will often provide sufficient information about the condition of the mine ceiling so that the second step can be eliminated. The testing is conducted in a borehole which is exposed to pressurized gas. If the measured rate of pressure loss is above some known dangerous level the tester is on notice that there are substantial cracks in the roof strata and further testing will be necessary. When this occurs a diffusion test will be carried out. The diffusion test is a process by which tracer gas is pumped into the borehole and a detector is used to locate any points where the gas is seeping through the mine ceiling. When gas is found to have leaked through the mine roof, the tester knows that dangerous vertical cracks exist which connect the ceiling to large horizontal cracks. At this point appropriate precautions should be taken to avoid injury to mining personnel.

When a mine is being excavated, several boltholes are typically drilled along the roof at the last working face of the mine room. This stage of the mining operation provides a convenient opportunity to employ the method of this invention. First, a worker drills a test borehole in the row of recently drilled boltholes. The diameter of the test borehole should be sufficiently small so that an inflated packer will form a tight seal with the walls of the hole. A typical diameter is approximately $1\frac{3}{8}$ inches. Obviously, boreholes which are drilled several feet deep will require a more extensive test so fully evaluate the strata in question. Usually, a two-to-three- feet-deep hole is sufficient to test for mine roof competency since most segments of roof rock over three feet thick tend to be self-supporting. Approximately eighty percent (80%) of the fatalities due to mine roof collapse involve segments of roof no greater than 24 inches thick.

The present invention is preferably carried out with a packer which serves two functions. It provides the gas pressure necessary to measure the effective rate of pressure loss in the borehole, and it supplies the tracer gas that is used to elucidate the location of cracks in the mine ceiling. The packer carries out these function by isolating a segment of the borehole so that pressure can be increased therein without being affected by ambient conditions.

Figure 1:
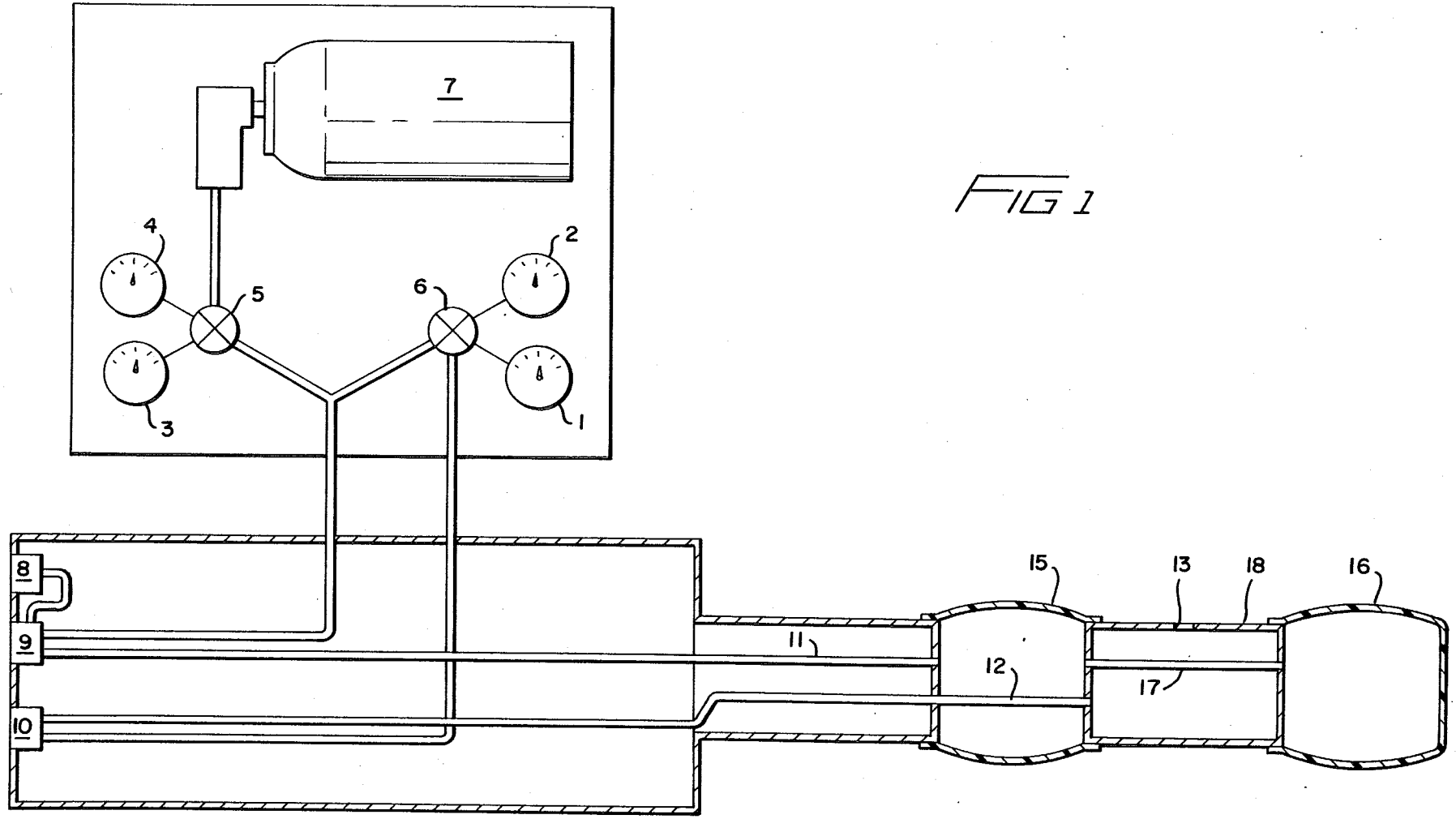

FIG. 1 illustrates the packer assembly and associated conduits. Shown are two identical inflatable packers 15 and 16 horizontally aligned with each other and spaced apart. Typically, these packers are made of neoprene rubber, but any sturdy elastic material will suffice. Pressurized gas is supplied to the first and second packers 15 and 16 through high pressure gas lines 11 and 17 respectively. When the packer assembly is inserted into the borehole, the packers can be inflated to the point where they snugly fit against the walls. Within the borehole, the two packers together with the borehole walls form the boundaries of an isolated test zone. Thus, various layers of strata can be tested independently merely by moving the packer assembly to different depths within the borehole.

The pressurized gas used for measuring pressure loss enters the borehole through hole 13 in the external tubing 18 located between the two packers. External tubing 18 is supplied with gas by low pressure gas line 12 which passes through the first packer.

Preferably, both the high and low pressure lines are supplied by the same gas source as shown at 7 in FIG. 1. Regulators 5 and 6 and pressure gauges 1, 2, 3 and 4 together with control valves 8, 9 and 10 serve to control the flow of gas between the high and low pressure lines and regulate the pressure to each.

Figure 2:
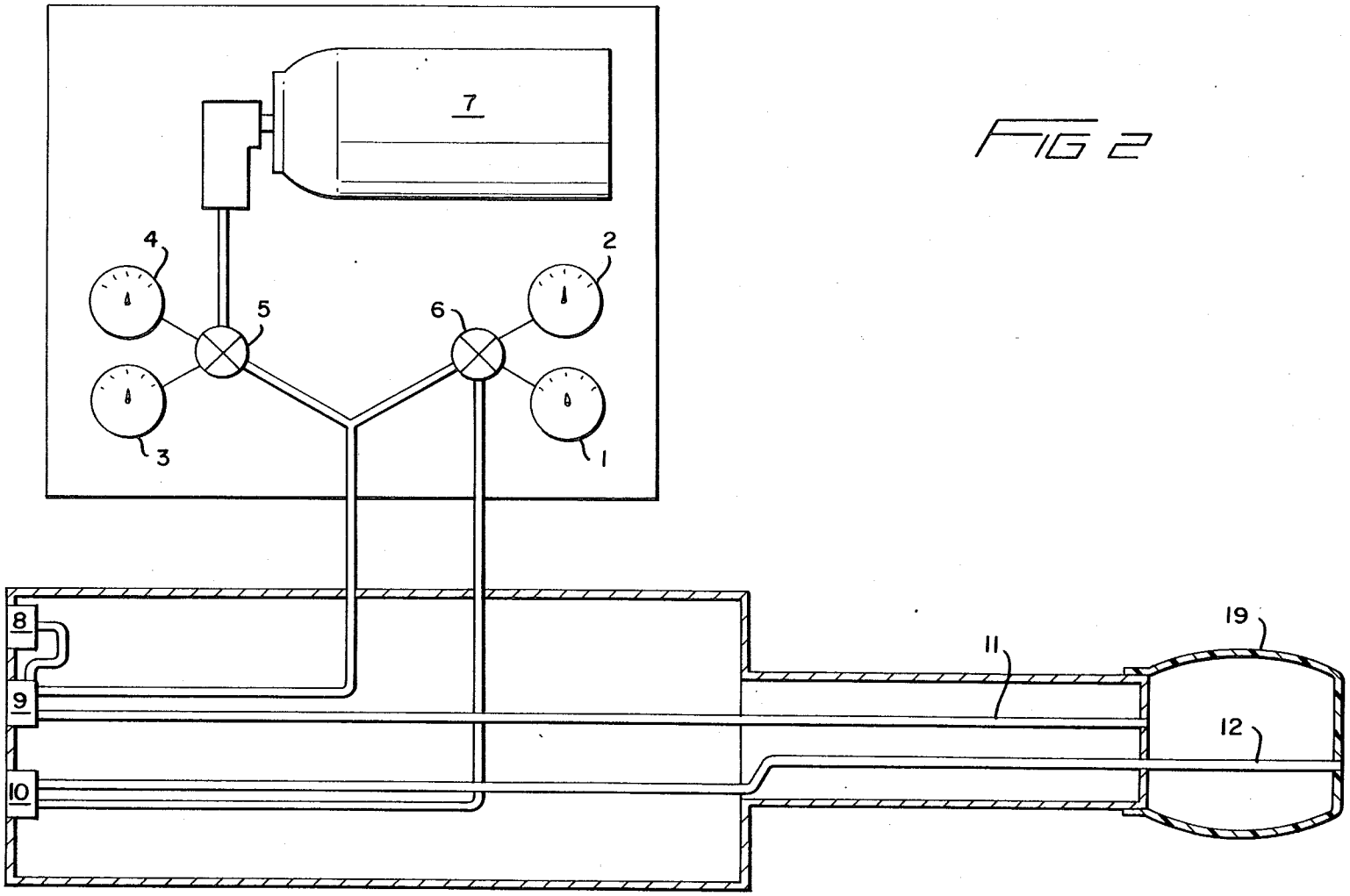

FIG. 2 illustrates a second embodiment of the packer assembly. This singular packer version has the same features as assembly shown in FIG. 1 except that the second packer 16 and the external tubing 18 of the double packer assembly have been removed. This type of packer assembly is used to test the deepest regions of the borehole, since a single inflated packer in the borehole will define an isolated region bounded on the bottom by the single packer and on the top by the upper end of the borehole.

In operation, the controls of the low pressure gas line are adjusted until the desired pressure is reached, whereupon the gas pressure supply is immediately cut off and the rate of pressure loss (attributable to gas leaking from the cracks in the borehole) is measured. Typically, the gas pressure in the borehole reaches 10 to 30 psi before it is shut off, while the pressure inside the packers is maintained at 50 to 70 psi. In the preferred embodiment, the pressure drop rate is measured for several, typically seven, vertical layers within the test borehole. In this manner, major flaws in the roof that exist only at a very narrow region of strata can be detected quickly and their positions pinpointed.

It has been found that most isolated layers of strata can be grouped into one of three categories based upon the rate of pressure drop therein. "Fast" zones exhibit full pressure loss in three seconds or less, while "slow" zones lose half of their pressure in 10 to 120 seconds, and "negligible" zones show no pressure loss in 120 seconds. The data from the various sections of the borehole, thus classified, may be combined into a weighted mine roof competency factor which is empirically correlated to the likelihood that the roof will collapse in the near future. A typical rating formula which might give "fast" zones a weight of 10, "slow" zones a weight of 5, and "negligible" zones zero weight, is of the form:

$$R = \frac{10\,N_f + 5\,N_S}{N_f + N_S + N_n}$$

where $N_f$ is the number of fast zones in the hole under investigation $N_s$ is the number of slow zones, and $N_n$ is the number of negligible zones.

Larger values of R are an indication of more dangerous mine roof conditions. Values of 5 or greater indicate that precautions against mine roof collapse need to be taken.

The mine roof competency factor may also take into account the depth of the strata from which the measurement was taken, giving less weight to those readings above depths of 3 feet and greater weight to those in the critical region near 2 feet or below. This follows from the fact, as already noted, that the great majority of the fatal mine roof collapses have involved rock of no greater thickness than 24 inches. The present invention covers the general type of experimental technique described above, no matter what formula is used, since other suitable expressions can be devised that will give adequate weight to the size and location of strata cracks. Further, the detection of lack of tracer gas diffusion through the mine ceiling will in some rare circumstances indicate that roof conditions are safe while the pressure drop data indicates otherwise. In this case the results of the diffusion survey supersede the pressure drop data, but the pressure-drop tester should still be used to monitor the conditions of the roof.

The second step of the invention method is employed only if the pressure loss evaluation indicates that cracks are present in the strata. In that case tracer gas is reinjected into the borehole and maintained at a constant pressure, usually 5 to 20 psi. As the tracer gas permeates the borehole walls and diffuses through cracks in the strata, it usually leaks through the mine ceiling. The presence of tracer gas in the mine opening shows that there are vertical cracks connecting the mine room to large horizontal cracks, and that the roof is in danger of collapsing.

Many commercial tracer gas detectors are available for use with this invention. Good results have been obtained with the Ion Track Instruments Model 56 ("ITI") hand held "Leakgun" which has been found to be small enough and sensitive enough for most mine applications when used with a one percent (1%) sulfur hexafluoride in air tracer gas mixture. However, other gas detectors can be used in lieu of the ITI Model 56 so long as they are of sufficient sensitivity and convenient size for use in mines. A single supply of the sulfur hexafluoride mixture can be used to furnish the necessary pressure to carry out both the pressurizing and diffusion steps of this invention.

Safety is of paramount importance when testing mine ceilings which are potentially hazardous. Thus, long probes may advantageously be attached to the tracer gas detector so that diffusion surveys of the borehole and the areas surrounding the borehole can be safely conducted from under the protection of the bolted roof area.

Figure 3:
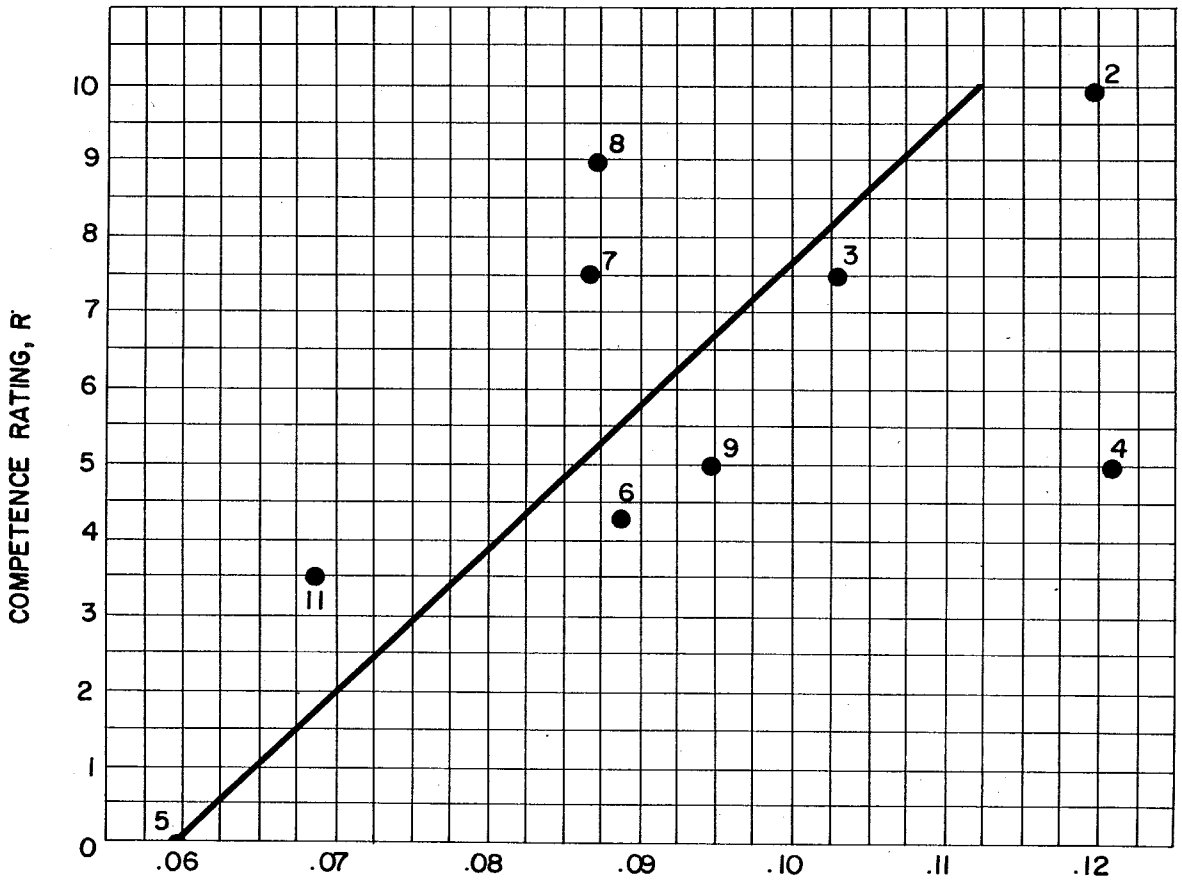

Although the method of the present invention is quite sensitive to the kinds of conditions that are likely to lead to mine roof failure, its ultimate effectiveness will depend upon empirical refinements made in the field. Equations taking advantage of the pressure drop factors are useful only to the extent that they can be correlated to a probability that the mine roof will collapse. Obviously, even if a large number of mine roofs are tested, the chances that a statistically significant number will collapse in the near future is remote. To provide more useful empirical evidence, a mine roof deflection study was conducted. Areas of widely divergent roof conditions were subjected to upward forces sufficient to cause measurable roof compression. These deflections were then compared with the rate of pressure loss in nearby boreholes tested with packer assemblies. Forces of between 5000 and 30,000 pounds of pressure generally cause a displacement that is primarily a function of the number and size of the roof cracks. Thus, the degree of roof deformation in this area should be a good indicator of the probability of eventual roof collapse. FIG. 3 shows a plot of the correlation between the rate of pressure loss as expressed by the mine roof competancy factor $$R = \frac{10\,N_f + 5\,N_S}{N_f + N_S + N_n}$$

and the slope of absolute displacement over the force applied in 5000 to 30,000 pound range.

The straight line is an estimated linear regression line through the data. Using the nine points shown in FIG. 3, a linear correlation coefficient of 0.653[13] was calculated. For the appropriate degrees of freedom, (7=9−2), this corresponds to a probability of 0.058 that two uncorrelated variables would yield a correlation coefficient this large. If data point 4 is omitted, the probability reduces to 0.012 (for 6 degrees of freedom).

Many of the boreholes used to test the present method were also observed with a fiber optics boroscope. The boroscope located only one-half (½) of the number of cracks located by the pressure drop method, indicating the superiority of the present method over visual techniques. It is also worth noting that some mine ceilings which appear to be dangerously cracked on visual inspection and in fact evidence large rates of pressure drop when tested with a packer assembly, are determined to be safer when surveyed for tracer gas during the diffusion step of this invention.

It has been shown that this method can detect cracks of area greater than 100 $ft^2$ and thickness less than 3/32 of an inch. It is also capable of detecting cracks that are located above a first or lower crack close to the mine ceiling. This is quite important since each additional horizontal crack increases the danger of mine roof collapse. Some other methods for testing mine roof competency, such as sound wave reflection techniques are unable to detect any further defects above the first crack. Detection of cracks at different depths accomplished through use of the method of this invention is limited only by the length of the borehole, but a depth of two to three feet is sufficient for most mines.

I claim:

1. A method of assessing mine roof competency comprising the steps of:
   (a) injecting gas under positive pressure into an isolated region of a borehole drilled in a mine roof to be tested; and
   (b) measuring the rate of pressure loss through the borehole region;
   whereby high rates of pressure loss constitute an indication of a potentially dangerous mine roof condition.

2. A method according to claim 1, comprising in addition to steps (a) and (b):
   (c) supplying a stream of tracer gas at a fixed pressure into the borehole; and
   (d) surveying the mine ceiling region near the borehole with a tracer gas detector, such that steps (c) and (d) should be carried out only if step (b) rate of pressure loss indicates a potentially dangerous mine roof condition.

3. A method according to claim 2, wherein said stream of tracer gas is applied to the rock strata in said mine roof by a packer assembly.

4. A method according to claim 2, wherein said tracer gas is sulfur hexafluoride.

5. A method according to claim 2, wherein a long probe is used in conjunction with said tracer gas detector.

6. A method according to claim 1, wherein the borehole is drilled close to the boltholes nearest the working face.

7. A method according to claim 1, wherein an inflatable packer assembly is used to isolate and pressurize a region of the borehole.

8. A method according to claim 1, wherein the roof competency is tested at several vertical layers within the borehole.

9. A method according to claim 8, wherein the rates of pressure loss measured at several vertical layers are utilized to calculate a weighted mine roof competency factor corresponding to the likelihood of mine roof collapse.

10. A method according to claim 9, wherein the mine roof competency factor is calculated according to the formula $$R = \frac{10\,N_f + 5\,N_S}{N_f + N_S + N_n}$$

where $N_f$ is the number of fast zones in the hole under investigation $N_s$ is the number of slow zones, and $N_n$ is the number of negligable zones.

11. A method according to claim 10, wherein values of 5 or higher for R indicate that precautions against mine roof collapse need to be taken.

12. An apparatus for assessing mine roof competency which comprises:
   (a) means for injecting gas under positive pressure into an isolated region of a borehole drilled in a mine roof to be tested,
   (b) means for measuring the rate of pressure loss through the borehole region,
   (c) means for supplying a stream of tracer gas into the borehole, and
   (d) means for detecting seepage of tracer gas through the mine roof near the borehole.

* * * * *